United States Patent [19]

Ohlsen et al.

[11] Patent Number: 4,918,289

[45] Date of Patent: Apr. 17, 1990

[54] ELECTRIC HAIR DRYER

[75] Inventors: Heinz-Jürgen Ohlsen, Wuppertal; Hans-Dieter Poweleit, Haan, both of Fed. Rep. of Germany

[73] Assignee: Robert Krups Stiftung & Co. Kg., Solingen, Fed. Rep. of Germany

[21] Appl. No.: 315,457

[22] Filed: Feb. 23, 1989

[30] Foreign Application Priority Data

Mar. 5, 1988 [DE] Fed. Rep. of Germany ..... 3807287

[51] Int. Cl.[4] ..... H05B 1/02; A45D 20/38; F24H 3/04

[52] U.S. Cl. ..... 219/370

[58] Field of Search ..... 219/370, 364, 369, 379, 219/366, 367, 373, 374, 375; 34/96–101

[56] References Cited

U.S. PATENT DOCUMENTS

| | | | |
|---|---|---|---|
| 4,195,217 | 3/1980 | Moller et al. | 34/97 |
| 4,308,670 | 1/1982 | Bonnema | 34/97 |
| 4,647,757 | 3/1987 | Haastrup | 219/370 |
| 4,767,914 | 8/1988 | Glucksman | 219/370 |
| 4,769,572 | 9/1988 | Voigt | 219/370 |
| 4,794,225 | 12/1988 | Maese | 219/370 |

FOREIGN PATENT DOCUMENTS 3545268 6/1987 Fed. Rep. of Germany ..... 219/370

*Primary Examiner*—M. H. Paschall
*Assistant Examiner*—Geoffrey S. Evans
*Attorney, Agent, or Firm*—Peter K. Kontler

[57] ABSTRACT

A portable electric hair dryer wherein the tubular part of the housing has an inlet for atmospheric air and an outlet for heated air. The housing confines an electric motor for an impeller which induces the flow of air from the inlet toward the outlet, and an electric heater for the flow of air. The motor is surrounded by annular first insulating carrier of electric contacts which are connectable to an energy source, and the heater has a second insulating carrier for contacts which are separably connectable with the contacts on the first carrier and serve to supply energy to the heater. The first carrier has surfaces which engage adjacent surfaces on a stationary air guide having a socket for the motor behind the first carrier. The contacts on the first carrier can include flat plugs which are receivable between pairs of elastic prongs constituting the respective contacts on the second carrier, or vice versa.

24 Claims, 4 Drawing Sheets

ELECTRIC HAIR DRYER

CROSS-REFERENCE TO RELATED CASES

The electric hair dryer of the present invention is similar to those disclosed in commonly owned copending patent application Ser. No. 171,480 filed Mar. 21, 1988 by Heinz-Jürgen Ohlsen for "Portable Hair Dryer", in commonly owned copending patent application Ser. No. 234,795 filed Aug, 22, 1988 by Hans-Dieter Poweleit and Heinrich Komesker for "Portable Electric Hair Dryer", and in commonly owned copending patent application Ser. No. 301,541 filed Jan. 24, 1989 by Hans-Dieter Poweleit for "Portable Electric Hair Dryer".

BACKGROUND OF THE INVENTION

The invention relates to improvements in electric hair dryers of the type wherein a hollow housing defines an inlet for admission of cool air and an outlet for heated air and the housing confines a motor-driven rotor (e.g., an impeller) for including the flow of air from the inlet toward the outlet and an electric heater for the flow of air. More particularly, the invention relates to improvements in electric hair dryers of the type disclosed in the aforementioned copending patent application Ser. No. 301,541 of Hans-Dieter Poweleit for "Portable electric hair dryer".

The copending patent application of Poweleit dicloses an electric hair dryer wherein a first insulating carrier for electrical and/or electronic components in the motor circuit is provided with one or more first electric contacts which are separably connectable with complementary second electric contacts on a second insulating carrier forming part of or supporting the electric heater. This ensures that the heater can be connected with an energy source by way of contacts on the first insulating carrier as well as that the second insulating carrier and the heater can be readily coupled with or detached from the first insulating carrier. The first insulating carrier is a polygonal plate which is disposed in diametral plane of the motor and is receivalbe in a recess which is defined by two crossing plate-like sections of the second insulating carrier. The electric contacts on the first insulating carrier are adjacent slots which are provided in the front edge face of the first carrier and can receive suitably bent elastic lugs of electric contacts on the second carrier. An advantage of the hair dryer of Poweleit is that the second carrier and the electric heater can be assembled into a prefabricated unit which is readily connectable to and detachable from the first carrier. Moreover, the establishment of an electrical connection between the contacts on the first and second carriers entails the establishment of a mechanical connection between the two carriers and vice versa.

The just described carriers occupy a relatively large amount of space in the interior of the housing because the entire first carrier extends forwardly and beyond the motor to be partially received in the recess of the second carrier. Moreover, the establishment of an electrical connection between the contacts on the first and second carriers necessitates the application of a force which is required to simultaneously establish a mechanical connection between the two carriers. The overall length of the first carrier (as seen in the direction of the flow of air from the inlet toward the outlet of the housing) equals or approximates the length of the second carrier even thought the depth of the aforementioned notches in the front edge face of the first carrier is only a small or minute fraction of the length of a carrier.

OBJECTS OF THE INVENTION

An object of the invention is to provide an electric hair dryer, particularly a portable hair dryer, wherein the length of one of the insulating carriers is a minute fraction of the length of the other carrier.

Another object of the invention is to provide an electric hair dryer which can employ a relatively short and compact housing without affecting the heating action upon the flow of air between the inlet and the outlet of the housing.

A further object of the invention is to provide an electric hair dryer which exhibits all advantages of the aforediscussed hair dryer of Poweleit as well as the above outlined additional advantages.

An additional object of the invention is to provide a novel and improved carrier of electrical and/or electronic components for use in the above outlined hair dryer.

Still another object of the invention is to provide the hair dryer with a novel and improved air guide.

A further object of the invention is to provide a novel and improved method of installing the motor for the impeller in the housing of a portable electic hair dryer.

An additional object of the invention is to provide novel and improved electric contacts on the insulating carriers of the above outlined hair dryer.

Another object of the invention is to provide a novel and improved prefabricated unit including an insulating carrier and a circuit board for use in the above outlined hair dryer.

A further object of the invention is to provide the hair dryer with a novel and improved handle and with novel and improved means for securing the circuit board to the handle.

An additional object of the invention is to provide the hair dryer with novel and improved means for locating at least one of the insulating carriers in the housing.

Another object of the invention is to provide a hair dryer which can employ numerous components of heretofore known hair dryers.

A further object of the invention is to provide a hair dryer wherein the combined length of the motor and of the two insulating carriers is a fraction of the combined length of such parts in heretofore known hair dryers.

SUMMARY OF THE INVENTION

The invention resides in the provision of an electric hair dryer (particularly a portable electric hair dryer) which comprises a hollow housing having an air-admitting inlet and an air-discharging outlet which is remote from the inlet, means for inducing the flow of air through the housing from the inlet to the outlet including a rotor (such as an impeller) in the housing and an electric motor for the rotor, an electric heater for the flow of air in the housing, an insulating carrier which at least partially surrounds the motor, at least one first electric contact which is provided on the carrier and is adapted to be connected with an energy source, and at least one second electric contact provided on the heater and separably engaging the first contact to supply energy to the heater.

The heater can include a second carrier and the at least one second contact is provided on the second carrier. The at least one first contact is preferably provided at that side of the insulating carrier which confronts the outlet of the housing. It is preferred to provide the housing and the insulating carrier with complementary locating means which serve to maintain the insulating carrier in a predetermined position in the interior of the housing.

The insulating carrier can include or constitute a circumferentially complete annulus with a substantially centrally located opening for the motor. The aforementioned locating means can include an internal surface of the housing and the peripheral surface of the annulus. Such locating means can further comprise one or more shoulders provided in the housing and a major surface (opposite the aforementioned side) of the insulating carrier; the major surface abuts the shoulder or shoulders in the housing in the predetermined position of the insulating carrier.

The hair dryer preferably further comprises guide means (such as a stationary diffusor) for the air flow between the inlet and the outlet of the housing (normally between the inlet and the heater). The guide means is provided in the housing and is preferably provided with a socket for the motor. Such guide means can include an annular extension which surrounds the motor and has a shoulder forming part of the aforementioned locating means and abutting the major surface of the insulating carrier. The guide means preferably further comprises an end wall which is adjacent (and can constitute the bottom wall of) the socket, and a tubular portion surrounding the socket and disposed between the end wall and the extension. The guide means also comprises an annulus of guide vanes and a tubular holder of guide vanes. The holder spacedly surrounds the extension of the guide means, and the annular insulating carrier is disposed between the holder and the extension. The major surface of the insulating carrier abuts the aformentioned shoulder of the extension and a shoulder of the holder. The holder can form an integral part of the housing and can be provided with the aforementioned internal surface for the peripheral surface of the insulating carrier.

Still further, the guide means can include a substantially radially extending flange which is adjacent but spaced apart from the major surface of the insulating carrier. This provides room for one or more electrical and/or electronic components on or adjacent the major surface of the insulating carrier. The electrical and/or electronic component or components at the major surface of the insulating carrier can be disposed between the shoulder of the extension and the shoulder of the holder.

The insulating carrier and the guide means can be provided with cooperating first and second detent elements which serve to maintain the insulating carrier in the predetermined position. Thus, the afrorementioned locating means can serve to determine the predetermined position of the insulating carrier, and the male and female detent elements serve to more or less positively retain the insulating carrier in the predetermined position.

The insulating carrier (such as the aforementioned annulus) can include or constitute a substantially plate-like (particularly a washer-like) member, and the at least one first contact preferably extends substantially at right angles to the plate-like member toward the second carrier.

In accordance with one presently preferred embodiment, the at least one first contact includes a flat plug which extends through and beyond the aforementioned side of the insulating carrier and a soldered connection between the plug and the plate-like member at the major surface of the insulating carrier. The at least one second contact can include at least one elastic prong which engages the plug. It is prefered to provide the at least one second contact with two elastic prongs which flank the flat plug. Alternatively, the at least one second contact can include a flat plug and the at least one first contact then comprises at least one elastic prong which engages the flat plug, preferably two elastic prongs which flank the flat plug.

The at least one second contact can extend beyond an end face which is provided on the second carrier and confronts the insulating carrier. A tap can be connected with the at least one second contact for connection to the wire or wires of the electric heater.

The hair dryer preferably further comprises a circuit board which is provided in the housing, and means (such as one or more electrical conductors) for connecting the board to the insulating carrier so that the board and the insulating carrier can constitute a prefabricated or preassembled unit which is insertable into and removable from the housing. The board can be removably installed in a hollow handle of the housing. The handle and the board can be provided with cooperating detent elements for releasably holding the board in the handle. Such detent elements can include one or more recesses (e.g., in the form of holes, notches or slots) in the board, and one or more projections provided in and integral with the handle and each extending into one of the recesses.

The noval features which are considered as characteristic of the invention are set forth in particular in the appended claims. The improved electric hair dryer itself, however, both as to its construction and the mode of assembling the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
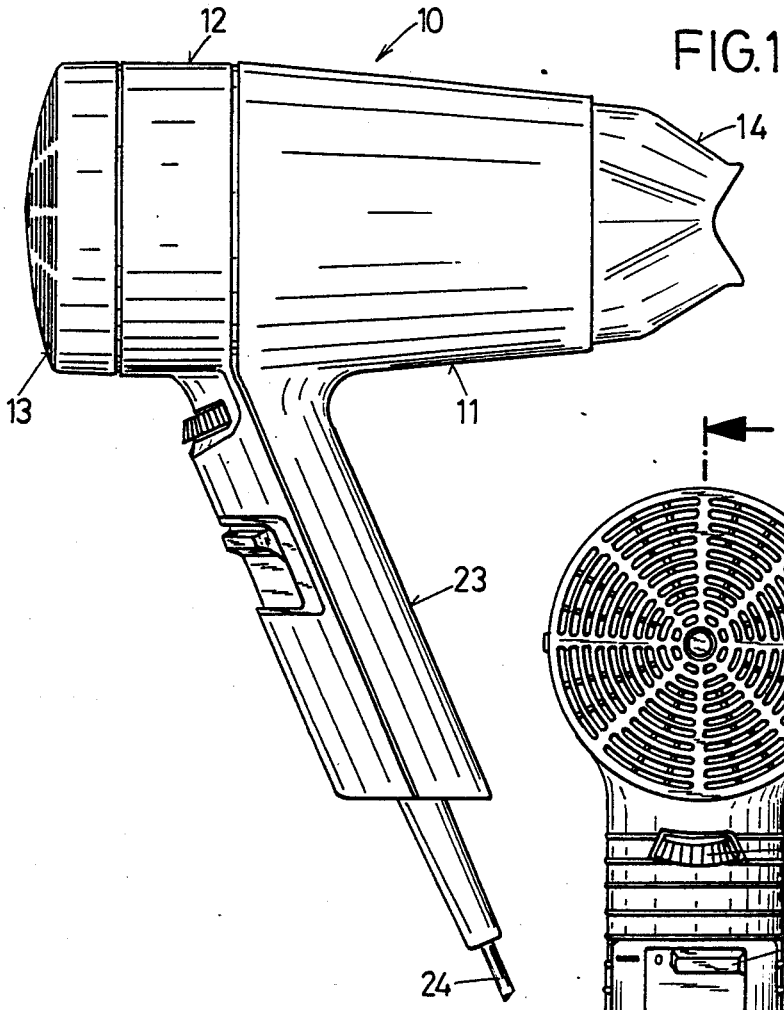
FIG. 1 is a side elevational view of a portable electric hair dryer which embodies the invention.

The drawing shows only those details of the improved portable electric hair dryer which are necessary for complete understanding of the invention. Thus, the drawing does not show all electrical and electronic components of the means for inducing the flow of air through the housing of the dryer and/or all electrical and electronic components of the means for heating the flow of air to a desired temperature. Moreover, certain components (particularly those on the insulating carriers) are shown only schematically since the exact construction of such components forms no part of the invention. The same applies for the means for connecting various components on the insulating carriers with an energy source. All such components which are not shown in the drawing or are shown only schematically but are necessary or desirable for proper operation of the hair dryer can be analogous to or identical with those employed in conventional electric hair dryers. Reference may be had, for example, to the so-called "Turbo Pocket" hair dryer which is manufactured by the assignee of the present application.

Figure 2:
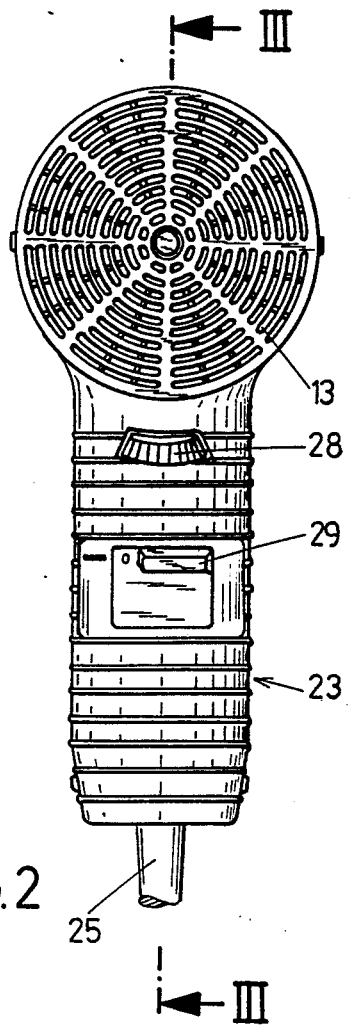
FIG. 2 is a rear elevational view of the hair dryer as seen from the left-hand side of FIG. 1.
Figure 3:
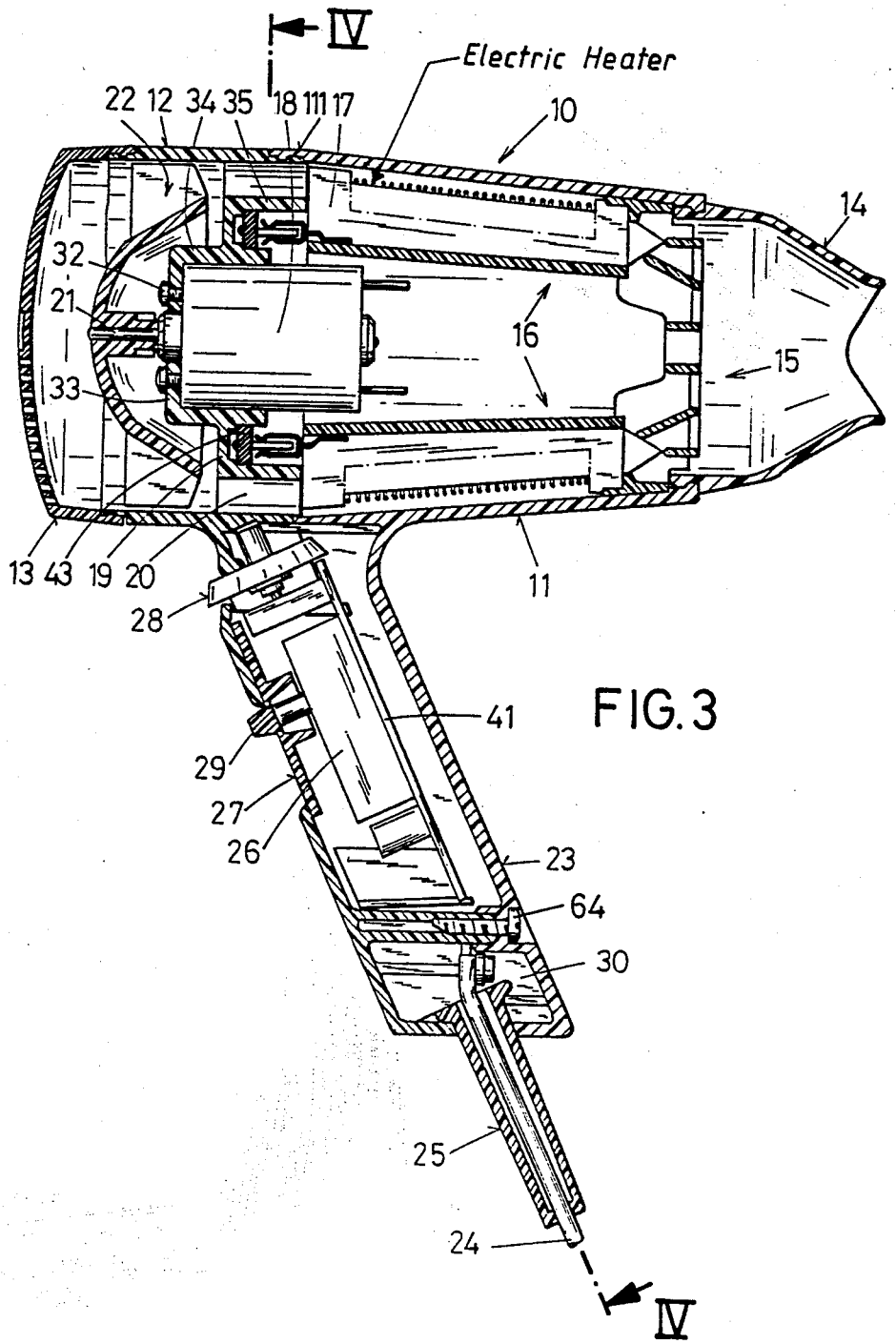
FIG. 3 is an enlarged central longitudinal sectional view of the hair dryer which is shown in FIGS. 1 and 2, substantially as seen in the direction of arrows from the line III—III of FIG. 2.

FIGS. 1 to 3 show a portable electric hair dryer 10 having a housing including a tubular part composed of a front section 11 and a rear section 12. The rear section 12 has an inlet for admission of atomspheric air, and the front section 11 has an outlet for heated air. The housing is made of an insulating mateiral, such as a suitable plastic. The sections 11, 12 are separably coupled to each other in a conventional manner, e.g., by one or more complementary male and female detent elements (one pair of such detent elements is shown in FIG. 3, as at 111) and by one or more threaded fasteners 64 which separably connect two through-shaped portions of a hollow pistol grip handle 23 having a front portion integral with the front section 11 and a rear portion integral with the rear section 12.

The rear section 12 of the tubular part of the housing is separably connected with a screen or filter 13 having an array of apertures for admission of atmospheric air into the housing. The means for releasably coupling the section 12 with the screen 13 is or can be identical with the detent elements 111. As can be seen in FIG. 2, the apertures in the screen 13 constitute arcuate slots which form several concentric annuli.

The front end portion of the front section 11 of the tubular part of the housing is separably connected with a grate 15 which directs several streams of heated air into a detachable air flow concentrating nozzle 14. The grate 15 is preferably made of a single piece of plastic material and includes an outer ring, one or more additional rings within the confines of the outer ring, and several radially extending webs which connect neighboring rings to each other. At least one ring of the grate 15 preferably constitutes or resembles a hollow conical frustum which tapers in a direction toward the nozzle 14. The centers of all rings which form part of the grate 15 are preferably disposed on the common axis of the housing sections 11 and 12.

The outer ring of the grate 15 is recessed into the front end portion of the housing section 11 in order to provide room for insertion of the rear end portion of the nozzle 14. The rear end portion of the nozzle 14 is provided with several elastic prongs which can snap into sockets provided therefor in the internal surface of the front end portion of the housing section 11. This ensures that the nozzle 14 is reliably but separably coupled to the section 11 as well as that the nozzle 14 determines the front end position of the grate 15. The aforementioned elastic prongs and sockets can be formed during making of the nozzle 14 and section 11.

The grate 15 of the fully assembled hair dryer 10 is confined between the nozzle 14 and the insulating carrier 17 of an electric heater 16 which is installed in the section 11 and the rear end portion of which partially surrounds an electric motor 18. The section 11 is further provided with an internal shoulder for the front edge face of the outer ring of the grate 15; such front edge face abuts the internal shoulder of the section 11 in order to ensure that the grate 15 is held in an optimum position even if the nozzle 14 is detached from the section 11. The front end portion of the insulating carrier 17 extends into notches in the outer ring and/or in the radially extending webs of the grate 15. The heater 16 is conventional; therefore, the details of its heating element or elements are not shown in the drawing. Such heating element or elements must be connected with an energy source, and a feature of the present invention resides in the provision of novel and improved means for connecting the heating element or elements of the heater 16 with an energy source when the hair dryer 10 is to be put to use.

The heater 16 and its carrier 17 occupy a substantial part of the interior of the housing sections 11 and 12. In the illustrated embodiment, the heater 16 is installed in the front section 11.

Figure 4:
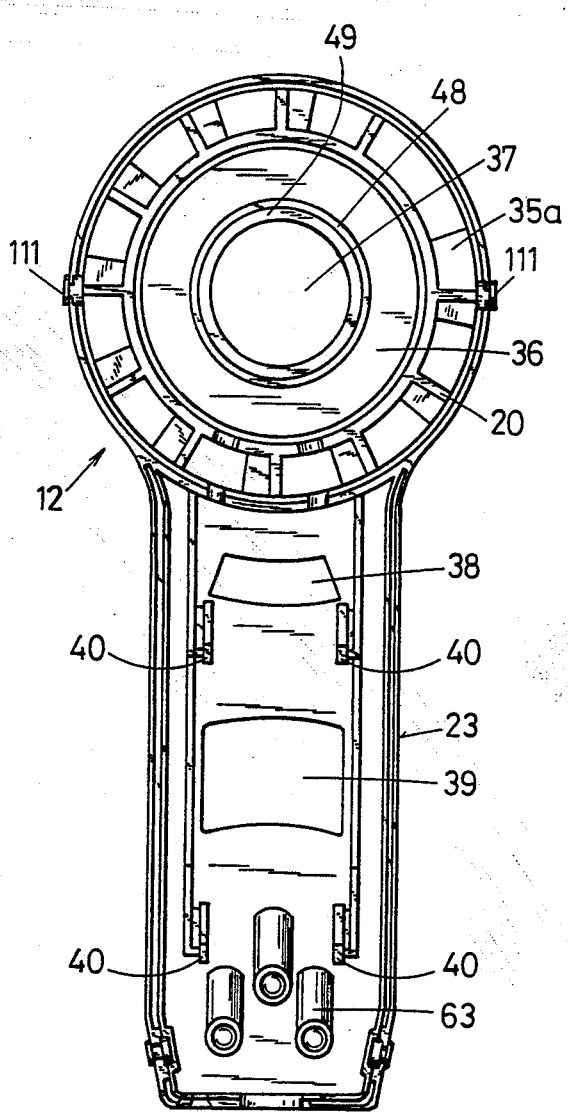
FIG. 4 is a view substantially as seen in the direction of arrows from the line IV—IV of FIG. 1, with the motor, carrier of motor contacts, on-off switch, regulator and electric cable omitted.
Figure 6:
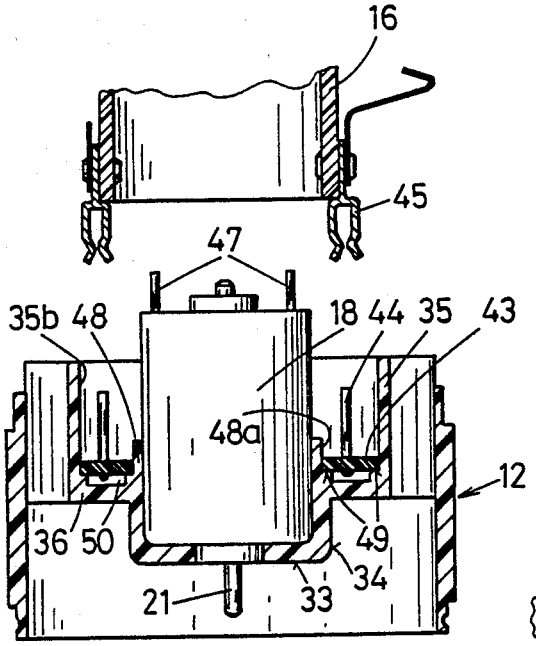
FIG. 6 is an enlarged view of a detail in the hair dryer of FIG. 3, with the heater detached from the carrier of motor contacts.

The rear housing section 12 is integral with a stationary guide or diffusor 20 which is connected to the section 12 by one or more ribs or webs 19 (such ribs or webs can jointly form a complete ring). The guide 20 has a centrally located flat median portion or rear end wall 33 behind a socket 37 (FIG. 4) for the rear portion of an electric motor 18. The central portion of the end wall 33 has an opening for the output shaft 21 of the motor 18. The casing of the motor 18 is separably affixed to the guide 20 by one or more screws 32 or other suitable fasteners extending through the rear end wall 33. The peripheral portion of the rear end wall 33 is integral with a forwardly extending tubular portion 34 which defines the socket 37 and is, in turn, integral with a radially outwardly extending flange 36 (FIG. 6). The periphery of the flange 36 is integral with a tubular holder 35 of guide vanes **35*a* for the flow of air between the inlet and outlet of that part of the housing which includes the tubular sections 11 and 12. The tubular portion 34 extends forwardly from the end wall 33, and the holder 35 extends forwardly from the flange 36. The guide vanes 35*a* are inclined with reference to planes extending radially of the section 12. The radially innermost portions of the vanes 35*a* are integral with the holder 35, and the radially outermost portions of these vanes are integral with the housing section 12. The guide vanes 35*a* are angularly offset with reference to the panels of the insulating carrier 17. This is desirable and advantageous because the vanes 35*a* cooperate with the carrier 17 to create turbulence in the region where atmospheric air enters the range of the heater 16 to thus reduce the temperature within the housing section 11. Therefore, the housing section 11 need not be made of a material which should be capable of standing elevated temperatures. This contributes to a reduction of the overall weight of the housing and to lower cost of the hair dryer 10**.

The purpose of the motor 18 is to drive a rotor 22 in the form an impeller having a hub affixed to the output shaft 21 behind the rear end wall of the guide 20. The impeller 22 draws air through the slots of the screen 13, and the guide vanes 35*a* of the guide 20 direct the flow of air into the range of the heater 16. Heated air flows through the grate 15 and is concentrated and directed by the nozzle 14.

The casing of the illustrated motor 18 is a cylinder which is snugly received in the complementary socket 37 of the guide 20, i.e., within the confines of the tubular portion 34 of the guide 20. The tubular portion 34 has a forwardly projecting cylindrical extension 48 (FIGS. 4 and 6) with an external shoulder 49 for the rear (major) surface 61 of a plate-like insulating carrier 43 behind the carrier 17 of the heater 16. The carrier 43 is a circumferentially complete annulus which spacedly surrounds a median portion of the casing of the motor 18 between the holder 35 of guide vanes 35*a* and the extension 48 of the tubular portion 34. The washer-like carrier 43 has a substantially centrally located opening 57 for the casing of the motor 18 and extension 48, a peripheral surface 60 which is closely or immediately adjacent the internal surface 35*b* of the holder 35, an internal surface 62 which is adjacent the external surface 48*a* of the extension 48, the aformentioned rear (major) surface 61 which abuts the external shoulder 49 of the extension 48 and an internal shoulder 49 of the holder 35, and a front side which faces toward the outlet of the housing section 11, i.e., toward the heater 16 and its carrier 17. The parts 35, 48 of the guide 20 and their surfaces 35*b*, 48*a* and shoulders 49 cooperate with the surfaces 60, 61 and 62 of the carrier 43 to locate the latter in a predetemined position within the housing section 12, namely in a plane between the axial ends of cyclindrical casing of the motor 18.

The central portion of the major surface 61 of the carrier 43 (between the two shoulders 49) is spaced apart from the flange 36 to define therewith an annular space 50 (FIG. 6) which serves to accommodate several electricl and/or electronic components 52 (see particularly FIG. 5) which are mounted on the carrier 43. The exact nature of the components 52 forms no part of the present invention; they can be identical with the components on an insulating contact carrier in a conventional electric hair dryer, such as the aformementioned "Turbo Pocket" of the assignee of the present application. Additional electrical and/or electronic components 52 are or can be provided at the front side or surface of the carrier 43, i.e., at that side which confronts the carrier 17 of the heater 16. Furthermore, the front side of the carrier 43 supports terminals for electrical conductors 58 and elastic contacts 56 which are engageable with terminals 47 (FIG. 6) of the motor 18 when the carrier 43 is properly installed between the holder 35 and extension 48 of the guide 20 so that its major surface 61 abuts the shoulders 49. The elastic contacts 56 are connected to the respective terminals on the carrier 43 by flexible conductors 56*a* so that they can be affixed to the terminals 47 which extend forwardly beyond the casing of the motor 18.

Figure 7:
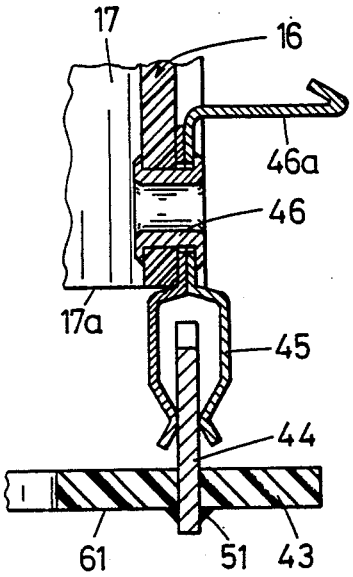
FIG. 7 is an enlarged view of a detail in FIG. 6, showing a female contact of the heater in engagement with a male contact on the carrier of motor contacts.

FIGS. 6 and 7 show one presently preferred embodiment of contacts which can separably couple the carriers 17, 43 to each other in order to establish an electrical connection between the heater 16 and an energy source. The contacts 44 on the carrier 43 are flat plugs which extend at right angles to the plane of the carrier 43 and are flanked by pairs of elastic prongs of the corresponding complementary contacts 45 extending rearwardly beyond the rear edge face or end face 17*a* of the carrier 17. Each contact 45 is permanently affixed to the carrier 17 by a hollow rivet 46 which is further connected with a tap 46*a* of the heater. This tap is connectable to the current-consuming element or elements of the heater 16. Each flat plug 44 extends through the carrier 43 and is affixed thereto by a soldered connector 51 in the space 50 in front of the flange 36. The elastic prongs of each contact 45 must be spread apart in order to permit entry of the respective plug 44 so that the latter is in proper electrical contact with the respective rivet 46 and tap 46*a*. The rear end portions of the elastic prongs of each contact 45 are bent outwardly to guide the plug 44 into the space between the two prongs when the carriers 17 and 43 are separably coupled to each other by moving the rear edge face 17*a* toward the front side of the carrier 43 and/or vice versa. The task of coupling the carriers 17, 43 to each other by way of cooperating contacts 44 and 45 is simplified because the contacts (plugs) 44 extend forwardly beyond the carrier 43 and the contacts 45 extend rearwardly beyond the rear edge face 17*a* of the carrier 17. In the embodiment of FIGS. 1 to 7, the carrier 43 is provided with three plus 44 and the carrier 17 is provided with three contacts 45. The number of plugs 44 and contacts 45 can be reduced to less than three or increased to four or more without departing from the spirit of the invention. The exact manner in which the contacts 45 are connected to the current-consuming element or elements of the heater 16 forms no part of the invention. All that counts is that one of the carriers 17, 43 be provided with contacts which are engageable by contacts on the other carrier so that one of the carriers can carry elements which connect the current-consuming components on the other carrier with an energy source. In the illustrated embodiment, the carrier 43 carries contacts or plugs 44 which connect the contacts 45 (and hence the heater 16) with an energy source.

Figure 8:
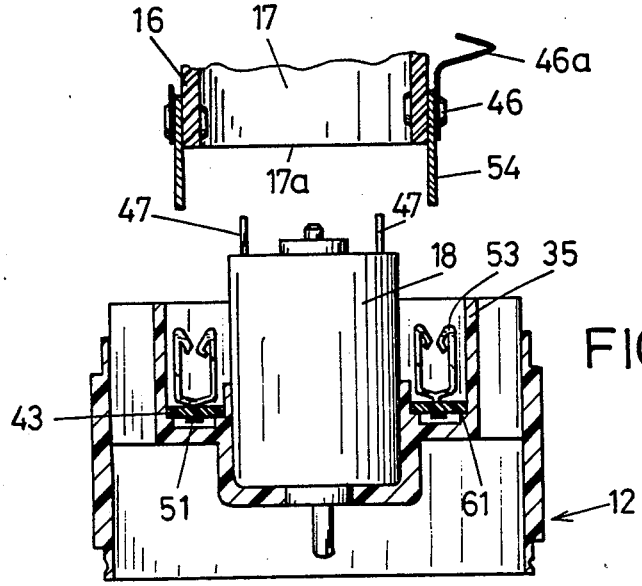
FIG. 8 is a view similar to that of FIG. 6 but showing a carrier of female motor contacts which can be engaged by male contacts of the heater.

FIG. 8 shows a portion of a modified electric hair dryer wherein the contacts 54 which project beyond the rear edge face 17*a* of the carrier 17 are flat plugs and the contacts 53 at the front side of the washer-like carrier 43 comprise pairs of elastic prongs which can frictionally engage the respective plugs 54. Each plug 54 is secured to the carrier 17 by a rivet 46 which is further connected with a tap 46*a*. The plugs 54 penetrate between the prongs of the respective contacts 53 in response to movement of the heater 16 toward the carrier 43 and/or vice versa. The contacts 53 can serve to arrest the heater 16 in an optimum position with reference to the motor 18 when the coupling of the carrier 17 to the carrier 43 is completed.

The hollow handle 23 of the housing makes an oblique angle with the tubular part including the housing sections 11, 12. As already mentioned above, the rear portion of the handle 23 is integral with the section 12 and the front portion of the handle is integral with the section 11. The interior of the handle 23 confines certain electrical and/or electronic components of the hair dryer 10. Such components include an electric on-off switch 26 at the rear side of a printed circuit board 41. The switch 26 is adjacent a reciprocable shield 27 behind a window 39 (FIG. 4) in the rear portion of the handle 23. The handle 23 is provided with suitable guides or tracks cooperating with followers along the marginal portions of the shield 27 to confine the latter to reciprocatory movements relative to the handle. The shield 27 is provided with an actuator in the form of a knob 29 which can be engaged by a finger to push the shield 27 to a first end position in which the swith 26 is on or to a second end position in which the switch 26 is off.

The window 39 in the rear part of the handle 23 is disposed at a level below a smaller second window 38 for a portion of a rotary wheel-shaped regulator 28 which can be turned by a finger of the hand holding the handle 23 in order to select the speed of the motor 18 and/or the heating action of the heater 16, i.e., the rate of air flow from the inlet (at 13) to the outlet (at 15) of the housing and/or the temperature of air issuing from the grate 15 or from the nozzle 14.

Figure 5:
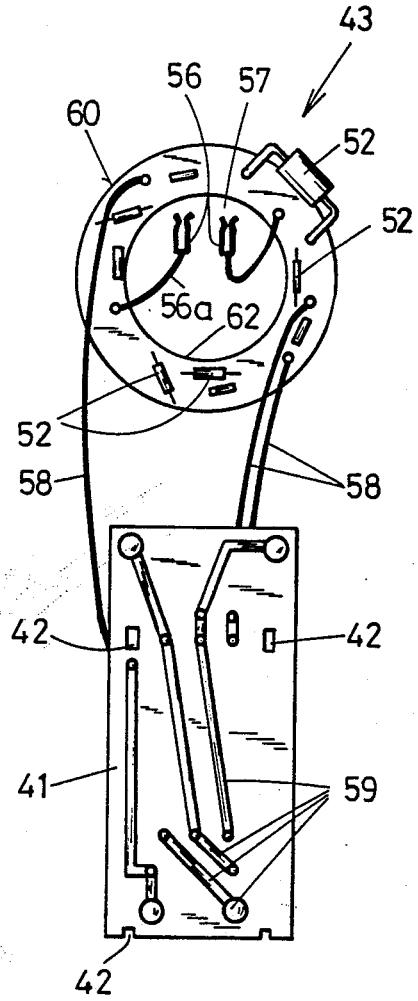
FIG. 5 is a rear elevational view of a prefabricated unit including the carrier of motor contacts and the printed circuit board for insertion into the handle of the hair dryer.

As can be seen in FIG. 5, the board 41 has a substantially rectangular outline and has female detent elements or recesses including two polygonal apertures 42 and two notches 42 for complementary male detent elements 40 (FIG. 4) in the form of projections 40 which are integral with and are disposed at the inner side of rear portion of the handle 23. The board 41 is provided with conductors and terminals 59 for connection to the switch 26 and to other components of the hair dryer 10. The rear portion of the handle 23 is further provided with forwardly extending tapped sockets 63 for the threaded fasteners 64 which cooperate with the detent elements 111 to hold the sections 11, 12 and the two portions of the handle 23 together.

The bottom end wall of the handle 23 has an opening for a portion of a tubular sheath 25 surrounding an electric cable 24. One end portion of the cable 24 is secured to the handle 23 by one or move clamps 30, and the other end portion of the cable 24 is provided with a standard plug (not shown) for connection to an outlet. The motor 18 is connected with the energy source when the plug of the cable 24 is inserted into the outlet and the switch 26 is on.

FIG. 5 shows that the washer-like carrier 43 and the board 41 are assembled into a prefabricated unit. The means for connecting the carrier 43 to the board 41 comprises the electrical conductors 58 which connect certain terminals on the board 41 with certain terminals on the carrier 43. The length of the conductors 58 suffices to ensure that the opening 57 of the carrier 43 can surround the extension 48 of the guide 20 while the board 41 is properly coupled to the rear portion of the handle 23 by the aforementioned projections 40. Portions of the conductors 58 can extend into complementary grooves or recesses in the front edge face of the holder 35 of guide vanes **35*a***.

The improved hair dryer 10 is susceptible of many additional modifications without departing from the spirit of the invention. For example, and as already mentioned before, the means for properly locating the carrier 43 in the annular chamber between the holder 35 and extension 48 of the guide 20 need not include only the aforementioned surfaces **35*b*, 48*a*, 60, 61, 62 and shoulders 49 but can also include detent means for releasably but positively (e.g., form- or force-lockingly) securing the carrier 43 in a predetermined position with reference to the housing section 12 and guide 20. For example, the carrier 43 can be provided with one or more elastic prongs which snap into complementary recesses of the housing section 12 or guide 20 when the surface 61 of the carrier 43 abuts the shoulders 49. Alternatively, the elastic prong or prongs can be provided on the guide 20 and/or on the housing section 12 to enter complementary recesses in the carrier 43. Such detent means (which can be analogous to the detent means 111) ensure that the carrier 43 is properly located in the housing as soon as it assumes the position of FIG. 6 or 8, i.e., even before the contacts 44 or 53 of the carrier 43 are engaged by the contacts 45 or 54 of the carrier 17**.

Furthermore, it is not always necessary to employ a carrier 43 which is a circumferentially complete annulus. It is desirable to design the carrier 43 in such a way that it at least partially surrounds the casing of the motor 18 and that it need not project forwardly beyond the motor. If the casing of the motor has a polygonal or other non-circular outline, the configuration of the tubular portion 34 and extension 48 of the guide 20 as well as the shape of the surface 62 surrounding the opening 57 in the carrier 43 can be changed accordingly.

The configuration of contacts on the carriers 17 and 43 can depart from the configuration of contacts 44, 45 (FIGS. 6–7) or 53, 54 (FIG. 8). Still further, it is possible to embody the invention in hair dryers having housings which depart from the housing including the sections 11, 12 and handle 23. The carrier 43 and the board 41 may but need not be assembled into a unit.

An important advantage of the improved hair dryer is that the carrier 43 occupies little room in the axial direction of the sections 11 and 12 of the housing. This is due to the fact that the carrier 43 is a plate-like member which is disposed in a plane extending substantially at right angles to the axes of the sections 11 and 12. The carrier 43 can be reliably located in an optimum position for proper engagement of its contacts 44 or 53 with the contacts 45 or 54 of the carrier 17, either solely as a result of engagement of its surfaces 60–62 with the surfaces **35*b*, 48*a* and shoulders 49 of the guide 20 and/or as a result of engagement of the aforementioned male and female detent elements on the carrier 43 and guide 20 and/or housing section 12. It is even possible to more or less permanently install the carrier 43 in the space around the motor 18, as long as the contacts 45 or 54 of the carrier 17 are separable from and reconnectable to the contacts 44 or 53 of the carrier 43**.

All electrical and/or electronic components 52, conductors 58, contacts 56, conductors **56*a* and contacts 44 or 53 can be mounted on the carrier 43 before the latter is installed in the housing section 12, and the carrier 43 can be connected to the board 41** to further simplify the assembly of the hair dryer.

Another important advantage of the improved carrier 43 and of its mounting in the chamber around the motor 18 is that the contacts 56 for the motor terminals 47 can be mounted on relatively short conductors **56*a* because the carrier 43 is installed in close or immediate proximity to the motor. The extension 48 of the guide 20 ensures that the carrier 43 need not directly contact the casing of the motor 18. In addition, the shoulder 49 and the surface 48*a* of the extension 48 contribute to proper positioning of the carrier 43 in the housing section 12. Still further, the extension 48 lengthens or deepens the socket 37 to ensure retention of the motor 18 in an otimum position with respect to the housing section 12 and guide 20. It has been found that the extension 48 facilitates rapid and convenient installation of the carrier 43 in the guide 20. The shoulders 49 are formed during making of the guide 20 so that their making does not require any additional operations. The provision of two shoulders 49 is desirable and advantageous because the surface 61 of the carrier 43 is properly located in the region of the peripheral surface 60 as well as in the region of the internal surface 62. The dimensions of the annular space 50 between the surface 61 of the carrier 43 and the flange 36 of the guide 20 are selected in such a way that the space 50 provides ample room for all electrical and/or electronic components which must be installed at the surface 61 in the region between the shoulders 49**.

The contacts 44, 45 or 53, 54 can be used for the establishment of a connection between the energy source (via cable 24) and the heater 16, between the energy source and a thermostat, between the energy source and the motor 18 and/or other current consuming or regulating parts of the hair dryer.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electric hair dryer, particularly a portable hair dryer, comprising a hollow housing having an air-admitting inlet and an air-discharging outlet spaced apart from said inlet; means for inducing a flow of air through said housing from said inlet to said outlet, including a rotor in said housing and an electric motor for said rotor; an electric heater for the flow of air in said housing; an insulating carrier at least partially surrounding said motor; at least one first electric contact provided on said carrier; and at least one second electric contact provided on said heater and separably engaging said first contact.

2. The hair dryer of claim 1, wherein said heater includes a second insulating carrier and said at least one second electric contact is provided on said second carrier.

3. The hair dryer of claim 1, wherein said carrier has a side confronting said outlet and said at least one first electric contact is provided at said side of said carrier.

4. The hair dryer of claim 1, wherein said housing and said carrier comprise complementary locating means fro maintaining said carrier in a predetermined position in the interior of said housing.

5. The hair dryer of claim 1, wherein said carrier includes an annulus having a substantially centrally located opening for said motor.

6. The hair dryer of claim 5, wherein said annulus has a peripheral surface and a major surface, said housing having an internal surface surrounding said peripheral surface and at least one shoulder abutting said major surface.

7. The hair dryer of claim 1, further comprising guide means for the air flow between said inlet and said heater, said guide means being provided in said housing and having a socket for said motor, said guide means including an annular extension surrounding said motor and having a shoulder, said carrier having a surface abutting said shoulder.

8. The hair dryer of claim 7, wherein said guide means further includes an end wall adjacent said socket and a tubular portion surrounding said socket adjacent said end wall and rigid with said extension.

9. The hair dryer of claim 1, further comprising guide means for the flow of air between said inlet and said heater, said guide means including an annulus of vanes, a holder for said vanes and an extension surrounded by said holder and surrounding said motor, said holder and said extension having shoulders and said carrier having a surface abutting said shoulders.

10. The hair dryer of claim 9, wherein said holder has an internal surface and said carrier has a peripheral surface adjacent said internal surface.

11. The hair dryer of claim 9, wherein said guide means further includes a flange which is spaced apart from said surface of said carrier, and further comprising at least one electrical component provided on said surface of said carrier adjacent said flange.

12. The hair dryer of claim 11, wherein said at least one component is diposed between said shoulders.

13. The hair dryer of claim 1, further comprising guide means for the flow of air between said inlet and said heater, said carrier and said guide means having cooperating first and second detent elements arranged to maintain said carrier in a predetermined position with reference to said housing.

14. The hair dryer of claim 1, wherein said carrier includes a plate-like member and said at least one first contact extends substantially at right angles to said plate-like member, said heater including a second carrier and said at least one second contact being provided on said second carrier.

15. The hair dryer of claim 14, wherein said plate-like member has a first side confronting said outlet and a second side confronting said inlet, said at least one first contact including a flat plug extending through said plate-like member and beyond said first side, and further comprising a soldered connection between said plug and said member, said at least one second contact including at least one elastic prong engaging said at least one first contact.

16. The hair dryer of claim 15, wherein said at least one second contact includes two elastic prongs which flank said plug.

17. The hair dryer of claim 14, wherein said at least one second contact includes a flat plug and said at least one first contact includes at least one elastic prong engaging said plug.

18. The hair dryer of claim 17, wherein said at least one first contact includes two elastic prongs which flank said plug.

19. The hair dryer of claim 1, wherein said heater includes a second carrier having an end face confronting said insulating carrier, said at least one second contact extending beyond said end face toward said insulating carrier.

20. The hair dryer of claim 1, further comprising a tap which is electrically connected with said at least one second contact.

21. The hair dryer of claim 1, further comprising a circuit board provided in said housing, and means for connecting said board with said carrier so that said carrier and said board constitute a prefabricated unit.

22. The hair dryer of claim 21, wherein said connecting means comprises at least one electrical conductor.

23. The hair dryer of claim 21, wherein said housing includes a hollow handle and said board is disposed in said handle, said board and said handle having cooperating detent elements for releasably holding said board in said handle.

24. The hair dryer of claim 23, wherein said detent elements include at least one recess in said board and at least one projection provided on said handle and extending into said recess.

* * * * *